US006018279A

United States Patent [19]

Arthur

[11] Patent Number: 6,018,279

[45] Date of Patent: Jan. 25, 2000

[54] RADIO FREQUENCY COUPLER

[75] Inventor: John W. Arthur, Edinburgh, United Kingdom

[73] Assignee: Racal-MESL Limited, Edinburgh, United Kingdom

[21] Appl. No.: 08/952,387

[22] PCT Filed: May 17, 1996

[86] PCT No.: PCT/BG96/01193

§ 371 Date: Feb. 12, 1998

§ 102(e) Date: Feb. 12, 1998

[87] PCT Pub. No.: WO96/37921

PCT Pub. Date: Nov. 28, 1996

[30] Foreign Application Priority Data

May 22, 1995 [GB] United Kingdom ..... 9510829

[51] Int. Cl.[7] ..... H01P 5/18; H01P 1/06; H01P 1/20

[52] U.S. Cl. ..... 333/116; 333/174; 333/175; 333/261

[58] Field of Search ..... 333/109, 116, 333/24 R, 24 C, 156, 161, 174, 175, 261

[56] References Cited

U.S. PATENT DOCUMENTS 3,143,717 8/1964 Gordon ..... 333/261

5,192,923 3/1993 Komatsu ..... 333/261 X 5,668,514 9/1997 Hashino et al. ..... 333/261

*Primary Examiner*—Paul Gensler

*Attorney, Agent, or Firm*—Leydig, Voit & Mayer, Ltd.

[57] ABSTRACT

A radio frequency (RF) coupler transfers RF power between a first circuit on a rotary shaft and a second circuit relative to which the shaft can rotate. The coupler comprises a first RF transmission line arranged to rotate with the rotary shaft about the rotation axis of the rotary shaft for connection to the first circuit and a second RF transmission line relative to which the first RF transmission line can rotate for connection to the second circuit. The first and second RF transmission lines comprise first and second electrically conductive tracks arranged coaxially around the rotation axis in mutually overlapping relationship to provide RF coupling between the first and second RF transmission lines. Each track has a gap defining a pair of ports. One of the ports of each track is connectable to a respective circuit and another port in the track is connected to a RF reflecting termination. A notch filter tunable to a desired frequency within a predetermined RF band is also described.

32 Claims, 5 Drawing Sheets

RADIO FREQUENCY COUPLER

BACKGROUND OF THE INVENTION

This invention relates to a radio frequency (RF) coudler and the invention relates particularly, though not exclusively, to an RF coupler for transferring RF power between a first circuit on a rotary shaft and a second circuit relative to which the shaft can rotate.

The invention also relates to a tunable notch filter.

International patent application no. PCT/GB91/00328 discloses an apparatus for measuring dynamic torque in a rotatable shaft. The apparatus comprises a surface acoustic wave (SAW) transducer mounted on the shaft, and requires coupling means for the efficient transfer of RF power between the transducer and processing circuitry which does not rotate with the shaft.

SUMMARY OF THE INVENTION

According to one aspect of the invention there is provided a radio frequency (RF) coupler for transferring RF power between a first circuit on a rotary shaft and a second circuit relative to which the shaft can rotate, the RF coupler comprising a first RF transmission line arranged to rotate with said rotary shaft and for connection to said first circuit, and a second RF transmission line for connection to said second circuit, wherein said first RF transmission line comprises a first, electrically conductive track having at least one termination, said second RF transmission line comprises a second, electrically conductive track having at least one termination, said first and second tracks are arranged coaxially around the rotation axis of the rotary shaft, said first track can rotate relative to said second track and said first and second tracks are arranged in substantial, mutually overlapping relationship to provide coupling between the first and second RF transmission lines.

According to another aspect of the invention there is provided a radio frequency (RF) coupler comprising a first RF transmission line mounted on a rotary shaft for rotation therewith and a second RF transmission line relative to which the first RF transmission line can rotate, wherein the first RF transmission line comprises a first electrically conductive track having at least one termination, said second RF transmission line comprises a second electrically conductive track having at least one termination, said first and second tracks are arranged coaxially around the rotation axis of the rotary shaft, said first track can rotate relative to said second track, said first and second tracks are in substantial overlapping relationship, each said track has a periodic undulation around the rotation axis, the undulation being formed by an integer number n of segments each subtending an angle $$\Delta = \frac{360^\circ}{n}$$

at the rotation axis, and said at least one termination in the track is formed in one of the segments thereof.

According to a yet further aspect of the invention there is provided a notch filter tunable to a desired frequency within a predetermined RF frequency band, the notch filter comprising a first RF transmission line and a second RF transmission line, wherein said first RF transmission line comprises a first, electrically conductive track having at least one termination, said second RF transmission line comprises a second, electrically conductive track having at least one termination, said first and second tracks are arranged coaxially around a rotation axis and are in substantial overlapping relationship to provide coupling between the first and second RF transmission lines, and said first and second tracks are capable of relative rotation about said rotation axis to tune the filter to the desired frequency.

The first and second electrically conductive tracks may comprise continuous electrically conductive layers or films formed by any suitable deposition technique such as screen printing or electrodeposition. Alternatively the tracks may be turned or wire wound.

DESCRIPTION OF THE DRAWINGS

Embodiments according to the invention are now described, by way of example only, with reference to the accompanying drawings in which.

DESCRIPTION OF PREFERRED EMBODIMENTS

Figure 1:
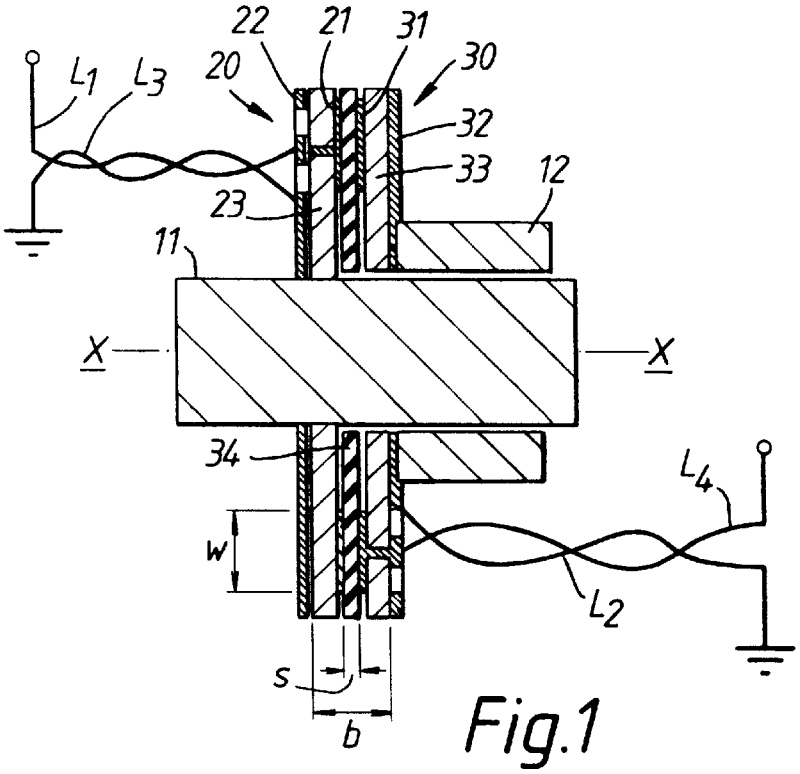
FIG. 1 shows a longitudinal sectional view through one embodiment of an RF coupler according to the invention.
Figure 2:
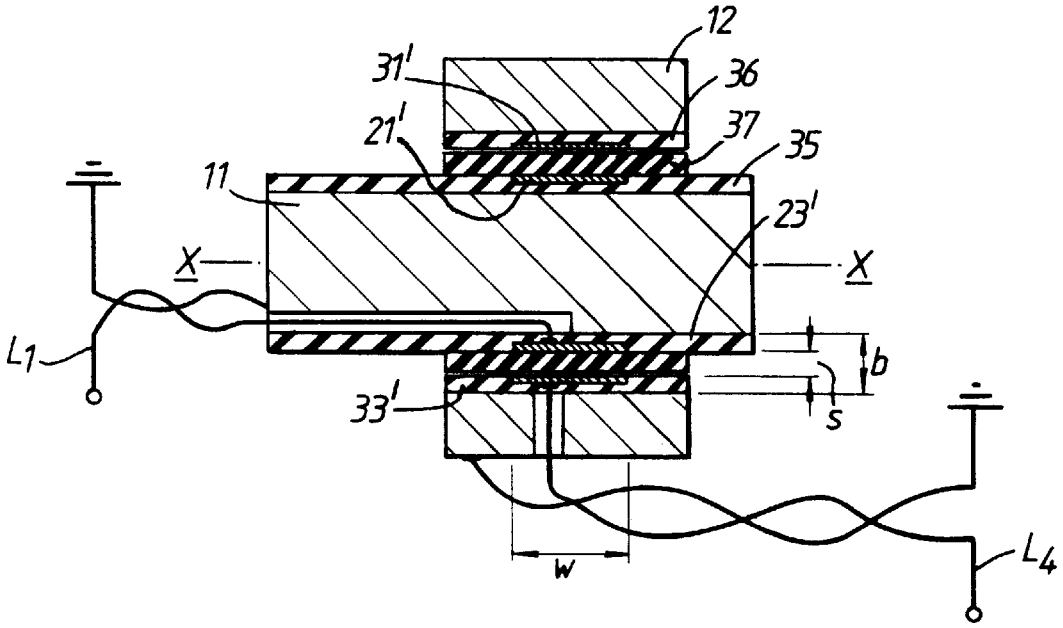
FIG. 2 shows a longitudinal sectional view through another embodiment of an RF coupler according to the invention.

FIGS. 1 and 2 show two alternative embodiments of an RF coupler according to the invention.

In each embodiment, the RF coupler is required to transfer RF power between a first RF circuit (not shown in the drawings) mounted on a rotary shaft 11 and a second RF circuit (also not shown) relative to which the shaft 11 can rotate.

The RF coupler comprises two coupled transmission lines 20, 30. Line 20 is mounted on the rotary shaft 11 for rotation therewith, whereas line 30 is mounted on a fixed coaxial bearing 12.

In the embodiment of FIG. 1, each transmission line 20, 30 comprises an arcuate, electrically-conductive track 21, 31 and a ground plane 22, 32 which are provided on opposite sides of an annular circuit board 23, 33. One of the circuit boards, 23 is fixed to the rotary shaft 11 and the other circuit board 33 is fixed to the bearing 12. The circuit boards 23, 33 are assembled so that the tracks 21, 31 and the ground planes 22, 32 lie in mutually parallel planes, orthogonal to the rotation axis x—x of shaft 11, with the tracks 21, 31 facing inwardly. The tracks are separated by a dielectric spacer 34. Alternatively the tracks may be separated by an air space.

Each track 21, 31 is in the form of an annulus and has a narrow gap defining a discontinuity in the annulus. The gaps are not shown in FIG. 1, but are best illustrated in the schematic representation of transmission lines 20, 30, shown in FIG. 3, where the gaps are referenced $G_1$ and $G_2$ respectively.

The opposite ends of track 21 form a pair of terminations in the track and define ports $P_1$ and $P_3$ in the first transmission line 20. Likewise, the opposite ends of track 31 form a pair of terminations in the track and define ports $P_2$, $P_4$ in the second transmission line 30.

In this embodiment, ports $P_1$ and $P_4$ are connected to the first and second RF circuits via lines $L_1$ and $L_4$ respectively, whereas ports $P_2$ and $P_3$ are both connected to a short circuit via the ground planes 22, 32 and lines $L_2$, $L_3$. Alternatively, ports $P_2$ and $P_3$ could be open circuit.

The tracks 21, 31 have the same radial dimensions, and they are arranged coaxially on the rotation axis x—x of shaft 11. Accordingly, the tracks remain in substantial, radially-overlapping relationship over a complete revolution of the shaft.

The coupling between the transmission lines 20, 30 depends, inter alia, upon such factors as the radial width w, axial spacing s and the degree of overlap between the respective tracks 21, 31.

The embodiment shown in FIG. 2 has a different geometry. In this case, the rotary shaft 11 and the fixed, coaxial bearing 12 have closely-fitting, cylindrical, dielectric sleeves 35, 36. One electrically conductive track 21' provided on the outer surface of sleeve 35 and another electrically conductive track 31' is provided on the inner surface of sleeve 36, and the tracks 21', 31' are separated by a cylindrical dielectric spacer 37 or, alternatively, by an air space.

Tracks 21', 31' are in the form of coaxial cylinders. However, as in the embodiment of FIG. 1, each track has a narrow gap creating a discontinuity in the cylinder wall and forming a pair of terminations in the track. Again, the opposite ends of track 21' define ports $P_1$ and $P_3$ in transmission line 20 and the opposite ends of track 31' define ports $P_2$ and $P_4$ in transmission line 30.

The tracks 21', 31' have the same axial width w and are aligned in the axial direction. Accordingly, they will remain in substantial, axially-overlapping relationship throughout a complete revolution of the rotary shaft 11.

In this embodiment, ground planes are provided by the outer surface 23' of shaft 11 and the inner surface 33' of bearing 12, and these components are themselves connected to a short circuit.

From an operational standpoint, the embodiments described with reference to FIGS. 1 and 2 are the same. However, the embodiment described with reference to FIG. 1 is preferred if there is radial play between the rotary shaft 11 and the coaxial bearing 12, whereas the embodiment described with reference to FIG. 2 is preferred if there is axial play between these components.

An analysis based on the theory of coupled transmission lines suggests that the coupler response may vary as shaft 11 rotates, and it is of course desirable that such variation be made as small as is possible.

Figure 3:
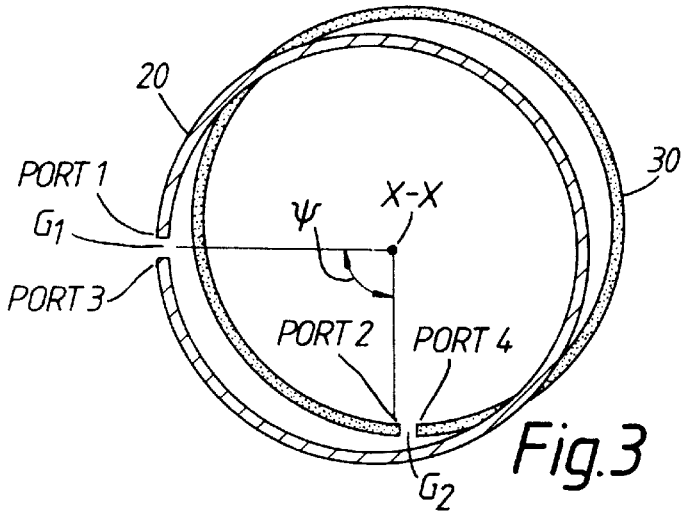
FIG. 3 shows a simplified representation of the RF couplers shown in FIGS. 1 and 2.

FIG. 3 shows a simplified representation of the RF couplers described with reference to FIGS. 1 and 2. As already explained, each transmission line 20, 30 has a narrow gap $G_1$, $G_2$ forming a pair of terminations. In FIG. 3, the gaps $G_1$, $G_2$ are shown to subtend an angle $\psi$ at the rotation axis x—x. The magnitude of $\psi$ will, of course, vary as shaft 11 rotates.

The analysis which follows takes account of RF power reflected at the interfaces presented by the terminations.

Figure 4:
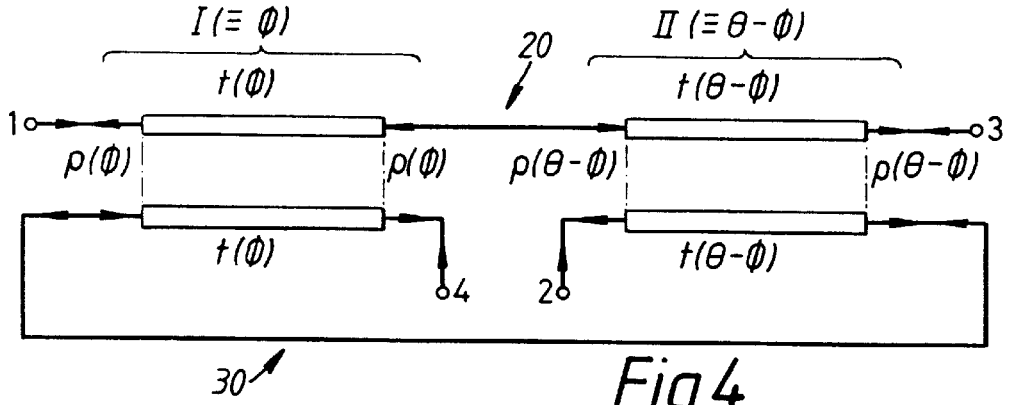
FIG. 4 is a schematic representation of the transmission lines 20, 30 shown in FIG. 3.

FIG. 4 is a highly schematic representation of the transmission lines 20, 30 shown in FIG. 3. In this representation, each transmission line 20, 30 has been separated into two distinct sections; namely, a section I within the included angle $\psi$ and a section II associated with the excluded angle, $(360°-\psi)$.

These sections I and II have respective line lengths $\phi$ and $\theta-\phi$.

Here, $\theta$ is the line length, expressed in radians, corresponding to the total length l of each transmission line 20, 30 and is defined by the expression $$\theta = \frac{2\pi}{\lambda} \cdot l \tag{1}$$

where $\lambda$ is the wavelength of RF radiation propagating in the coupler.

Similarly, $\phi$ is the line length, again expressed in radians, corresponding to the section of transmission line within the included angle $\psi$, whereas $\theta-\phi$ is the line length associated with the excluded angle $(360°-\psi)$. By way of illustration, if $$\theta = \frac{\pi}{2}$$

and $\psi=180°$, then $\phi$ and $\theta-\phi$ are both $$\frac{\pi}{4}.$$

.

Referring again to FIG. 4, $t(\phi)$ and $t(\theta-\phi)$ are coefficients representing transmitted RF power in the respective sections I,II of transmission line, whereas $\rho(\phi)$and $\rho(\theta-\phi)$ are coefficients representing reflected power in these sections of transmission line.

The values of these coefficients depend on the rotation angle $\psi$ and affect the coupling between the two transmission lines 20, 30.

Figure 5:
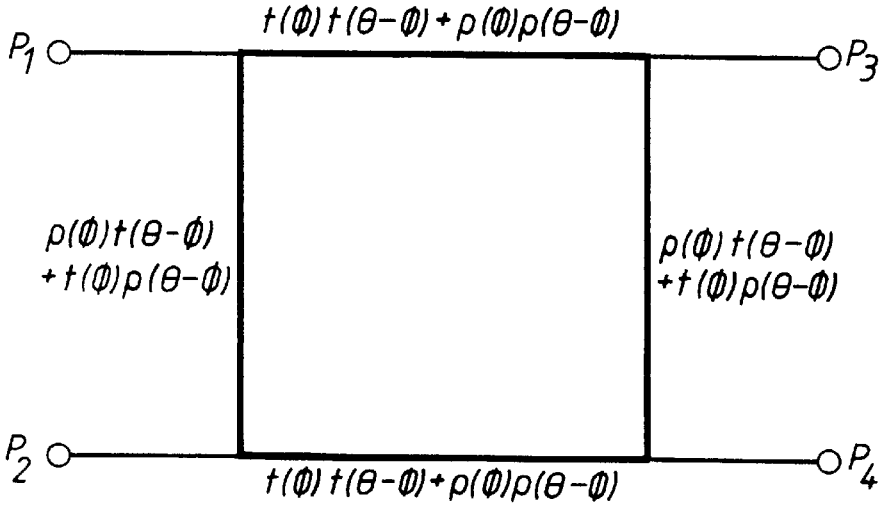
FIG. 5 is a consolidated representation of the transmission lines shown in FIG. 4.

FIG. 5 is a consolidated representation of the transmission lines 20, 30 derived from FIG. 4, and shows coefficients corresponding to the resultant RF power transferred between different pairs of ports.

From this representation it can be determined that the coefficient $S_{41}$, representing RF power transferred between ports $P_1$ and $P_4$, is given by the expression $$S_{41}=2(\rho(\phi)t(\theta-\phi)+t(\phi)\rho(\theta-\phi))\cdot(t(\phi)t(\theta-\phi)+\rho(\phi)\rho(\theta-\phi)) \tag{2}$$

Expressed generally, $$\rho(\alpha) = \frac{\rho(1 - e^{-j2\theta})}{(1 - \rho^2 e^{-j2\theta})} \tag{3}$$

and $$t(\alpha) = \frac{(1-\rho^2)e^{-j2\theta}}{1-\rho^2 e^{-j2\theta}} \tag{4}$$

where $\alpha=\phi$ or $\theta-\phi$, $e^{-j\theta}$ is the propagation phase factor for the transmission lines, and $\rho$ is the reflection coefficient corresponding to the characteristic impedance $Z_{oe}$ of the coupled transmission lines, given by the expression $$\rho = \frac{Z_{oe} - Z_o}{Z_{oe} + Z_o} \tag{5}$$

where $Z_o$ is the system characteristic impedance (assumed to be 50Ω, although other values of characteristic impedance could be used).

It can be shown that the RF couplers described with reference to FIGS. 1 and 2 both have a characteristic impedance $Z_{oe}$ given by the expression $$Z_{oe} = \frac{188.3}{\sqrt{\varepsilon}}\left(\frac{\frac{w}{b}}{1-\frac{s}{b}} + k + 0.4413\right)^{-1} \tag{6}$$

where $\epsilon$ is the dielectric constant, w,b and s having the meanings assigned to them in the drawings, and $$k = \frac{1}{\pi}\left[\ln\left(\frac{b}{b-s}\right) + \left(\frac{s}{b-s}\right)\ln\left(\frac{b}{s}\right)\right] \tag{7}$$

By combining equations (2)–(7) above, the transfer coefficient ($S_{41}$), and so the coupler response, can be determined for a complete revolution of the rotary shaft 11, i.e. or values of $\psi$ in the range from 0° to 360°.

By way of illustration, these determinations have been made using parameters based on a standard 3 dB hybrid coupler having fixed transmission lines, which requires that $$\theta = \frac{\pi}{2}$$

and $|t(\theta)|=|\rho(\theta)|$. By equating equations (3) and (4), and applying equation (5), it can be seen that the requirement that $|t(\theta)|=\rho(\theta)|$ leads to a reflection coefficient $\rho$of 0.414, corresponding to a characteristic impedance $Z_{oe}$ of 120.7Ω (assuming $Z_o$=50Ω).

Figure 6:
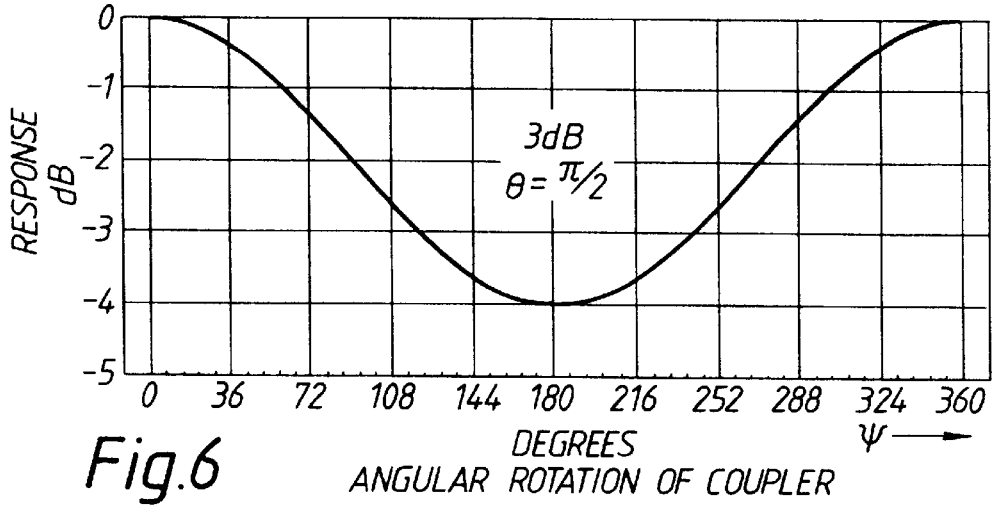
FIG. 6 shows the coupler response for a 3 dB coupler having a line length $$\theta = \frac{\pi}{2};$$

FIG. 6 shows the resultant coupler response. His shows that when $\psi$=0°, 360° i.e. the terminations are aligned, the coupler is effectively lossless. However, as $\psi$ increases the coupling between the transmission lines becomes progressively worse and the response falls, dropping to a minimum value of −4 dB when $\psi$=180°.

Surprisingly, it is found that the coupler response can be significantly improved if the line length $\theta$ is reduced from the standard value, $$\frac{\pi}{2}.$$

Figure 7:
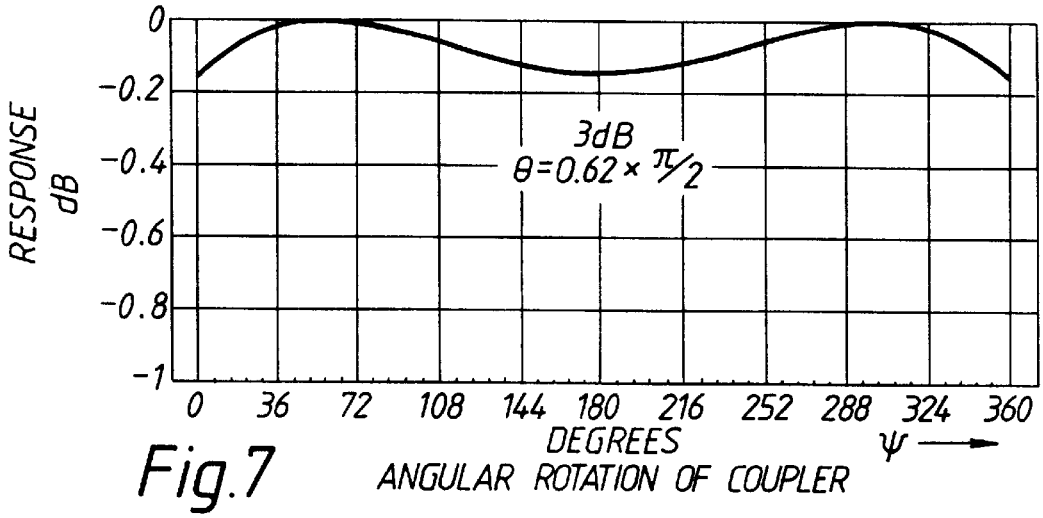
FIG. 7 shows the coupler response for a 3 dB coupler having a reduced line length.

. In fact, for a 3 dB coupler the optimum line length is found to be only 62% of the standard value. FIG. 7 shows the improved coupler response, which is never less than −0.16 dB. Due to the periodic nature of the frequency response of couplers in general, longer line lengths, periodic in $\pi$, could alternatively be used. Therefore, in general the optimum line length will differ significantly from $(n+\frac{1}{2})\pi$, where n is an integer.

It will, of course, be appreciated that in an alternative implementation of the present invention, the RF coupler may have transmission lines that are more or less tightly coupled than is the case in a 3 dB coupler.

Less tightly coupled transmission lines may be more appropriate where manufacturing tolerances do not permit a very narrow spacing s between the transmission line tracks. In the case of a 4 dB coupler, the optimum line length is found to be 93% of the standard value, $$\frac{\pi}{2}.$$

Figure 8:
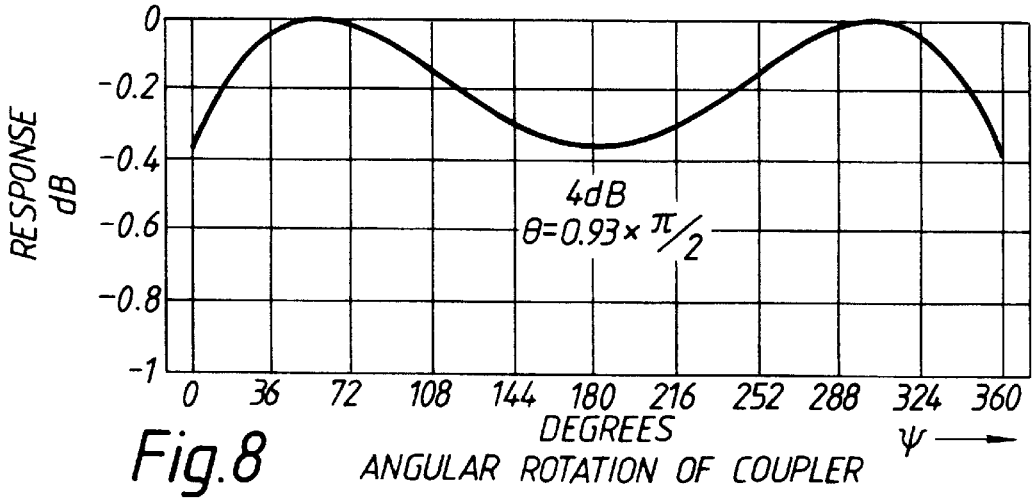
FIG. 8 shows the coupler response or a 4 dB coupler having a reduced line length.

. As shown in FIG. 8, this coupler still has a useful response which is never less than 0.37 dB.

In general, couplers having loosely coupled transmission lines have smaller characteristic impedances $Z_{oe}$. However, for values of $Z_{oe} \leqq 97.7\Omega$optimisation of the line length $\theta$ to a value different from the standard value, $$\frac{\pi}{2}$$

is not possible, because the latter value always gives the optimum result. Nevertheless, for a coupler having a characteristic impedance of $Z_{oe}$=97.7Ωthe variation of coupler response with rotation angle $\psi$ is still only 0.47 dB.

In the embodiment of FIG. 1, each track 21, 31 is in the form of an annulus. In a different embodiment, shown in FIG. 9, each track is constellated being made up of an integer number n of identical segments, where each segment subtends an angle $$\Delta = \frac{360°}{n}.$$

.

The two tracks are identical so that if the rotation angle $\psi$=0° or is an integer number of $\Delta$(i.e. $\psi=k\Delta$) they will be in perfect overlapping relationship, giving the optimum coupling. As the rotation angle $\psi$ changes from this value, the extent of overlap is reduced and the coupling between the tracks decreases, the coupling being a minimum when the rotation angle $\psi$ is a half integer multiple of $\Delta$(i.e.$\psi=(k+\frac{1}{2})\Delta$).

With this arrangement, the coupler response will be modulated at a frequency of n cycles for each revolution of the rotary shaft 11, and so provides a measure of the rotation angle $\psi$.

Figure 9:
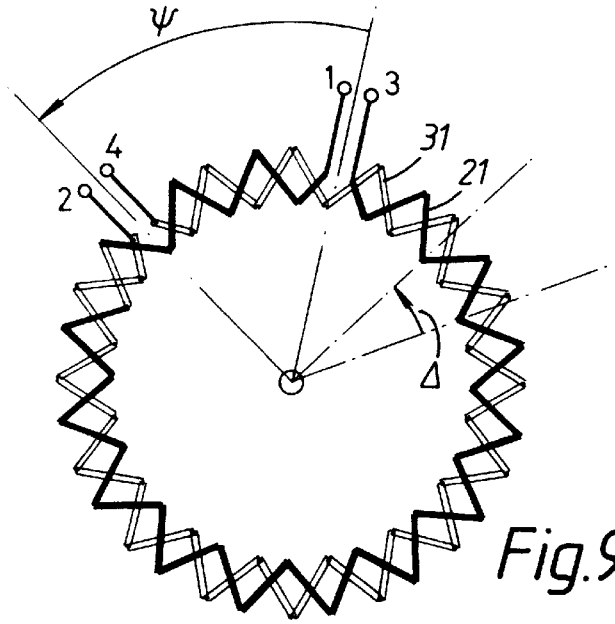
FIG. 9 shows an alternative form of track for use in a rotary coupler in accordance with the invention, FIGS. 10(*a*) to 10(*c*) illustrate different modulation line shapes obtained using tracks of the form shown in FIG. 9, FIGS. 11*a* and 11*b* show nulls in the coupler response for two different values of rotation angle.
Figure 10A:
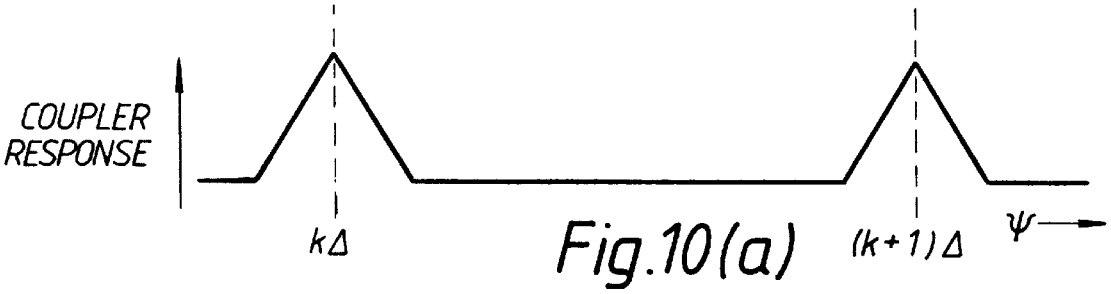
Figure 10B:
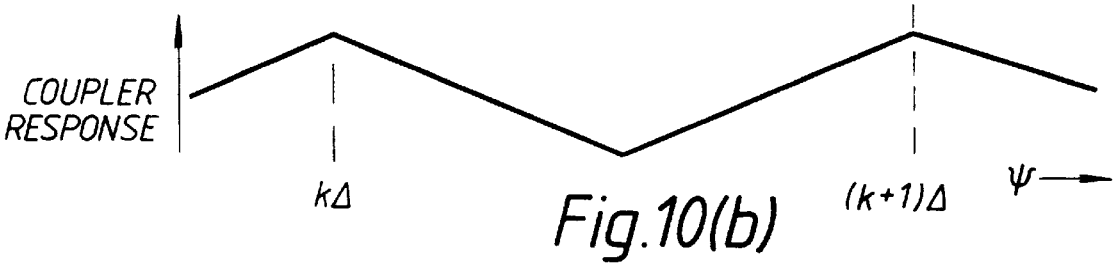
Figure 10C:
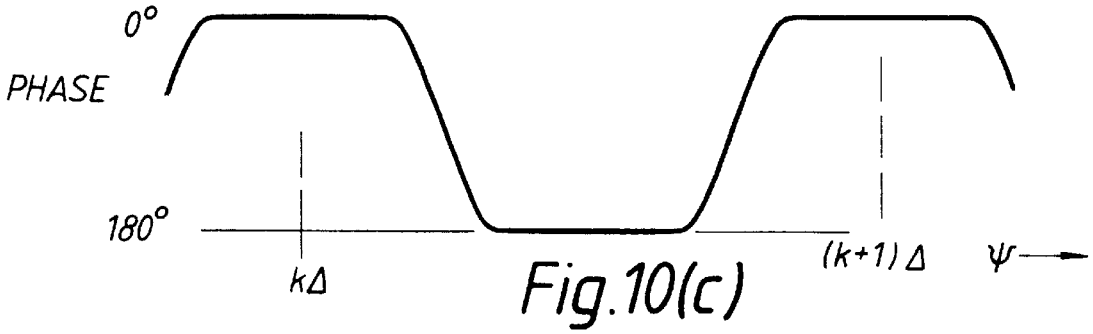

The line shape of the modulation depends upon the shape of the segments in the tracks. FIG. 10*a* shows the modulation line shape derived using triangular segments of the form shown in FIG. 9, FIG. 10*b* shows the comparatively smooth modulation line shape obtained using relatively shallow triangular segments, and FIG. 10*c* shows the line shape obtained using segments having a castellated, i.e. square or rectangular profile, and in this case the phase as well as the amplitude is modulated.

In another embodiment, two sets of tracks 21, 31 are provided, one track in each set being mounted on the rotary shaft 11 and the other track in each set being mounted on the fixed bearing 12. The input to, and the output from the coupler are connected to tracks which are either both mounted on the rotary shaft 11 or both mounted on the fixed bearing, and the remaining tracks are electrically interconnected. With this arrangement RF power is transferred from the input to the output via the electrically interconnected tracks.

In one implementation of this embodiment, the tracks 21, 31 in one of the sets are constellated, as already described, whereas the tracks in the other set are annular, as described with reference to FIG. 1. As described with reference to FIGS. 9 and 10, the coupler has a modulated output giving a measure of the rotation angle of rotary shaft. However, in this implementation, the input and the output are both either on the rotary shaft 11 or on the fixed bearing 12, and this may be advantageous in some applications.

In another implementation of the embodiment, both sets of tracks are constellated. The sets of tracks are identical, except that the tracks in one set are slightly offset about the rotation axis x—x of shaft 11 with respect to the tracks in the other set. With this arrangement, the coupler output consists of two modulated signals each of a form shown in FIGS. 10(*a*) to 10(*c*). Provided the angular offset between the two sets of tracks is not equal to $$\frac{\Delta}{2},$$

, the relative phases of the modulated signals give an indication of the sense of shaft rotation, the optimum angular offset being $$\frac{\Delta}{4}.$$

.

Figure 11A:
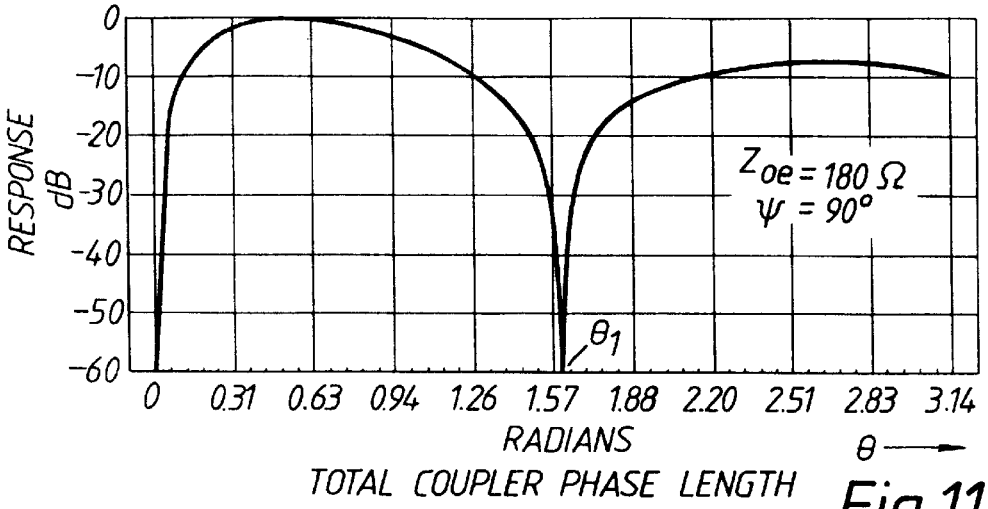
Figure 11B:
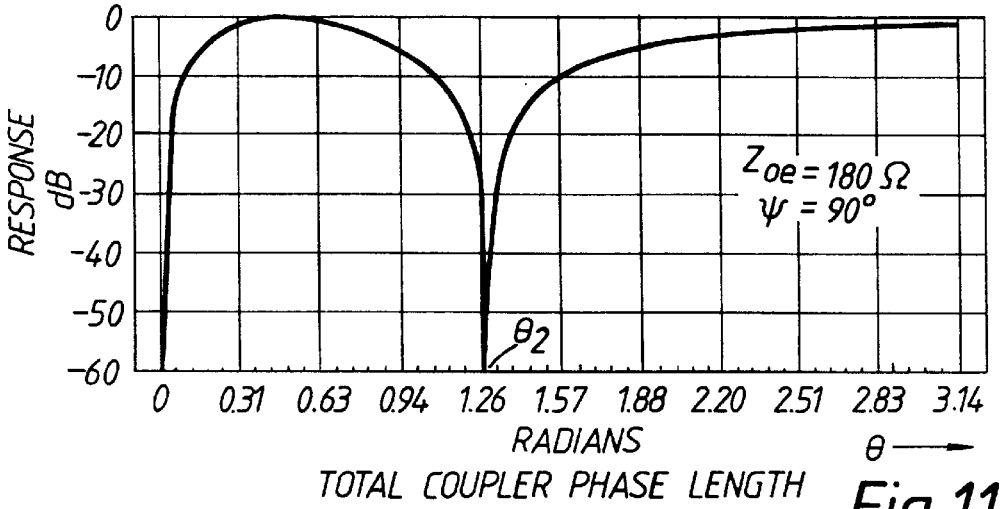

It has been found that the coupler response exhibits a share notch over a range of values of line length $\theta$ and rotation angle $\psi$, and the null is particularly prominent when the coupling is relatively tight. As the rotation angle $\psi$ is varied from a minimum value $\psi_{min}$ to a maximum value $\psi_{max}$, so the null is observed to shift continuously from a maximum value $\theta_{max}$ to a minimum value $\theta_{min}$ . FIGS. 11*a* and 11*b* illustrate how the position of the notch shifts from a high value $\theta_1$ to a lower value $\theta_2$ as the rotation angle $\psi$ changes from 90° to 180°, for a coupler having a characteristic impedance $Z_{oe}$ of 180 Ω. In general, it has been observed that while $\psi_{min}>0°$, $\psi_{max}=180°$.

Since the value of $\theta$ is proportional to frequency, it is possible, in an alternative application, to use the coupler as a notch filter which can be tuned over a frequency band defined by upper and lower limits, $\theta_{max}$ and $\theta_{min}$ , simply by varying the rotation angle $\psi$.

A notch filter based on the embodiments of FIGS. 1 and 2 has the drawback that the input to and the output from the filter must rotate with respect to each other, and for some applications this may be impractical.

Figure 12:
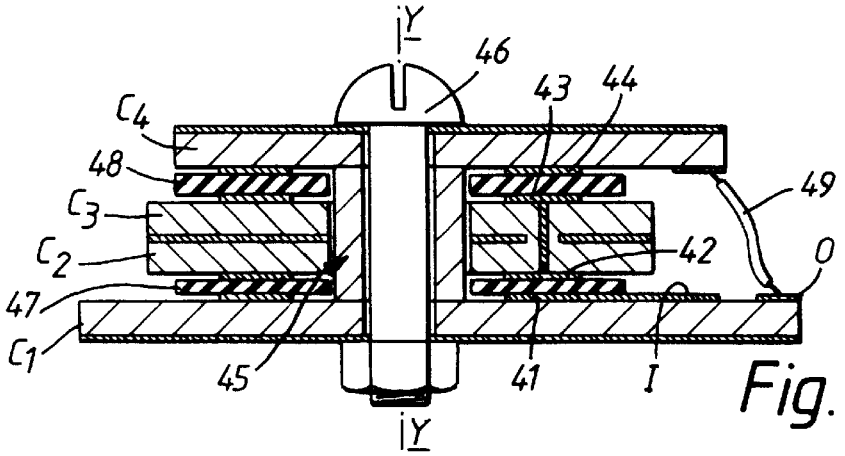
FIG. 12 shows a tunable notch filter.

FIG. 12 shows another embodiment of the tuned notch filter in which input and output terminals I,O of the filter are not required to rotate with respect to each other.

In this embodiment, the filter comprises four circuit boards $C_1$–$C_4$, each having an annular, electrically-conductive track 41, 42, 43, 44 of the form described hereinbefore—as before each track has a pair of terminations.

Circuit boards $C_1$,$C_4$ are fixed together in spaced-apart relationship by a bushing 45 and an associated fastener 46. Circuit boards $C_2$, $C_3$, which are positioned between circuit boards $C_1$, $C_4$, are also fixed together and are rotatable with respect to boards $C_1$, $C_4$, about an axis Y—Y. Circuit boards $C_1$,$C_2$ are separated by a dielectric spacer 47 and circuit boards $C_3$, $C_4$ are separated by a dielectric spacer 48.

The circuit boards are arranged coaxially , in parallel so that the respective pairs of tracks 41, 42; 43, 44 are in radially-overlapping relationship. Tracks 42, 43 on boards $C_2$, $C_3$ are electrically interconnected . The input and output terminals I,O are both provided on the same circuit board $C_1$, with the input terminal I being connected to track 41 and the output terminal O being connected to track 44 via a link 49.

If the tracks 41, 42, 43, 44 are all the same length, and the terminations in the tracks are aligned, the filter response will exhibit a single, relatively sharp notch (as shown In FIGS. 11*a* and 11*b*) which can be tuned to a desired frequency by rotating the interconnected circuit boards $C_2$, $C_3$ relative to the circuit boards $C_1$, $C_4$. If, on the other hand, the respective pairs of tracks 41, 42; 43, 44 have different lengths and/or the terminations in tracks 42, 43 and/or 41, 44 are offset with respect to each other, the filter response will exhibit two distinct notches, or a single, but relatively wide notch if the differences in track length and/or the extent of the offset are slight.

A similar arrangement based on multiple coaxial, cylindrical tracks of the form shown in FIG. 2, is also envisaged.

In the foregoing embodiments, the terminations are formed by gaps in the electrically conductive tracks. Alternatively, continuous, unbroken tracks may be used. In this case, a single connection made to each track forms a common termination in the track such that the pairs of ports $P_1$, $P_3$; $P_2$, $P_4$ are also common.

It will be appreciated from the foregoing that the described RF coupler is highly versatile. In one application, the RF coupler can be used to transfer RF power between fixed and rotating circuits, and to provide optimum coupling at all angles of rotation. In other applications, the coupler can be used to provide a measure of angular rotation and in yet further applications the coupler provides a tunable notch filter having fixed or relatively rotatable input and output terminals.

It is claimed:

1. A radio frequency (RF) coupler for transferring RF power between a first circuit on a rotary shaft having a rotation axis and a second circuit relative to which the shaft can rotate, the RF coupler comprising, a first RF transmission line arranged to rotate with said rotary shaft about said rotation axis and for connection to said first circuit, and a second RF transmission line relative to which said first RF transmission line can rotate and for connection to said second circuit, wherein said first and second RF transmission lines comprise first and second electrically conductive tracks arranged coaxially around said rotation axis in substantial, mutually overlapping relationship to provide RE coupling between the first and second RF transmission lines, each said electrically conductive track having a gap defining a pair of ports in the track, one said port being connectable to a respective said circuit and another said port being connected to a termination for reflecting RF power.

2. A coupler as claimed in claim 1 wherein said first and second tracks are supported in substantially parallel planes orthogonal to the rotation axis of the rotary shaft and are in radially-overlapping relationship.

3. A coupler as claimed in claim 2 wherein said first and second tracks are substantially annular.

4. A coupler as claimed in claim 2 wherein each said track has a substantially periodic undulation around said rotation axis, the undulation being formed by an integer number n of segments each subtending an angle $$\Delta = \frac{360^\circ}{n}$$

at the rotation axis and wherein said gap is formed in one of said segments.

5. A coupler as claimed in claim 2 wherein said first track is mounted on a first circuit board fixed to the rotary shaft and said second track is mounted on a second circuit board relative to which said first circuit board can rotate.

6. A coupler as claimed in claim 5 wherein said first RF transmission line comprises a first ground plane provided on one side of said first circuit board and said first track provided on the opposite side of said first circuit board, and said second RF transmission line comprises a second ground plane provided on one side of said second circuit board and said second track provided on the opposite side of said second circuit board.

7. A coupler as claim in claim 2 wherein said first and second tracks are separated by a dielectric spacer.

8. A coupler as claimed in claim 1 wherein said first and second tracks are arranged in axially-overlapping relationship.

9. A coupler as claimed in claim 8 wherein said first and second tracks are substantially cylindrical.

10. A coupler as claimed in claim 8 comprising a first dielectric cylindrical sleeve fixed to said rotary shaft and a second dielectric cylindrical sleeve arranged coaxially around the first sleeve and relative to which the first sleeve can rotate, said first and second tracks being respectively provided on the outer and inner surfaces of the first and second sleeves.

11. A coupler as claimed in claim 8 wherein said first and second tracks are separated by a cylindrical dielectric spacer.

12. A coupler as claimed in claim 1 wherein said first and second tracks have a line length θ which differs from $(n+\frac{1}{2})\pi$, where n is 0, 1, 2, 3 . . . .

13. A coupler as claimed in claim 12 wherein said first and second RF transmission lines are configured as a 3 dB coupler.

14. A coupler as claimed in claim 12 wherein said line length is $0.62\ \pi/2$.

15. A notch filter tunable to a desired frequency within a predetermined RF frequency band, the notch filter comprising, a first RF transmission line and a second RF transmission line, wherein said first and second RF transmission lines respectively comprise first and second electrically conductive tracks arranged coaxially around a rotation axis in substantial mutually overlapping relationship to provide RE coupling between the first and second RF transmission lines, each said electrically conductive track having a gap defining a pair of ports in the track, one of said ports being connectable to an input or an output of the notch filter and another of said ports being connected to a termination for reflecting RF power and said first and second electrically conductive tracks being capable of relative rotation about said rotation axis to tune the notch filter to the desired frequency.

16. A notch filter as claimed in claim 15 wherein said first and second tracks are supported in substantially parallel planes orthognal to said rotation axis and are in radially-overlapping relationship.

17. A notch filter as claimed in claim 16 wherein said first and second tracks are substantially annular.

18. A notch filter as claim in claim 16 wherein the first track is mounted on a first circuit board and said second track is mounted on a second circuit board which can rotate with respect to the first circuit board.

19. A notch filter as claimed in claim 18 wherein said first RF transmission line comprises a first ground plane provided on one side of said first circuit board and said first track provided on the opposite side of said first circuit board, and said second RF transmission line comprises a second ground plane provided on one side of said second circuit board and said second track provided on the opposite side of said second circuit board.

20. A notch filter as claimed in claim 16 wherein said first and second tracks are separated by a dielectric spacer.

21. A notch filter as claimed in claim 15 wherein said first and second tracks are arranged in axially-overlapping relationship.

22. A notch filter as claimed in claim 21 wherein said first and second tracks are substantially cylindrical.

23. A notch filter as claimed in claim 22 wherein said first and second tracks are respectively provided on the outer and inner surfaces of first and second coaxial dielectric sleeves.

24. A notch filter as claimed in claim 22 wherein the first and second tracks are separated by a cylindrical dielectric spacer.

25. A notch filter as claimed in claim 15 wherein said first RF transmission line includes two said electrically-conductive tracks, said second RF transmission line includes two said electrically-conductive tracks said, tracks being arranged coaxially around said rotation axis so that the tracks of said first RF transmission line are in substantial radially-overlapping relationship with the tracks of the second RF transmission line to provide RE coupling between the first and second RF transmission lines, and wherein the tracks of one of said first and second RF transmission lines are electrically and mechanically interconnected and are rotatable about said rotation axis with respect to the tracks of another of said first and second RF transmission lines whereby to tune the filter to the desired frequency, and the input to and the output from the filter are connected to respective tracks of said another of the RF transmission lines.

26. A notch filter as claimed in claim 25 wherein said tracks are provided on different circuit boards and the input and output terminals for the filter are both provided on the same circuit board.

27. A notch filter as claimed in claim 26 wherein the gasp in the tracks of the second RF transmission line are aligned with respect to each other.

28. A notch filter as claimed in claim 26 wherein the gaps in the tracks of said first RF transmission line or in the tracks of said second RF transmission line are offset with respect to each other.

29. A notch filter as claimed in claim 26 wherein the tracks all have the same length.

30. A notch filter as claimed in claim 26 wherein respective tracks of the first and second RF transmission lines have different lengths.

31. A radio frequency (RF) coupler comprising a first RF transmission line mounted on a rotary shaft having a rotation axis and a second RF transmission line relative to which the first RF transmission line can rotate, wherein the first and second RF transmission lines comprise first and second electrically conductive tracks arranged coaxially around said rotation axis in substantial overlapping relationship, each said track having a gap defining a pair of ports in the track, one of said ports being connected to a termination for reflecting RF power and each said track having a periodic undulation around the rotation axis, the undulation being formed by an integer number n of segments each subtending an angle $$\Delta = \frac{360^\circ}{n}$$

at the rotation axis, and said gap is formed in one of the segments thereof.

32. A coupler as claimed in claim 31 wherein said first RF transmission line includes two said electrically conductive tracks, said second RF transmission line includes two said electrically conductive tracks, said tracks being arranged coaxially around said rotation axis so that the tracks of the first RF transmission line are in substantial radially overlapping relationship with the tracks of the second RF transmission line to provide RF coupling between the first and second RF transmission lines, wherein one or both of said tracks of the first and second RF transmission lines have said periodic undulation, the tracks of one of said first and second RF transmission lines are electrically interconnected and the tracks of another of said first and second RF transmission lines are respectively connected to the coupler input and the coupler output.

* * * * *

UNITED STATES PATENT AND TRADEMARK OFFICE

CERTIFICATE OF CORRECTION

PATENT NO. : 6,018,279

DATED : January 25, 2000

INVENTOR(S) : John W. ARTHUR

It is certified that an error appears in the above-identified patent and that said Letters Patent is hereby corrected as shown below:

On the title page, item

"[86] PCT No.: PCT/BG96/01193" should read -- [86] PCT No.: PCT/GB96/01193 --

Signed and Sealed this

Third Day of April, 2001

*Attest:*

Nicholas P. Godici

NICHOLAS P. GODICI

*Attesting Officer*

*Acting Director of the United States Patent and Trademark Office*